US008346500B2

(12) United States Patent
Lee et al.

(10) Patent No.: US 8,346,500 B2
(45) Date of Patent: Jan. 1, 2013

(54) SELF CHECK-TYPE FLAME DETECTOR

(75) Inventors: Yeu Yong Lee, Seoul (KR); Seung Hun Choi, Seongnam-si (KR)

(73) Assignee: Chang Sung Ace Co., Ltd., Gyeonggi-Do (KR)

( * ) Notice: Subject to any disclaimer, the term of this patent is extended or adjusted under 35 U.S.C. 154(b) by 309 days.

(21) Appl. No.: 12/884,752

(22) Filed: Sep. 17, 2010

(65) Prior Publication Data

US 2012/0072147 A1 Mar. 22, 2012

(51) Int. Cl.
*G06F 19/00* (2011.01)

(52) U.S. Cl. ..... 702/134; 702/64; 702/75; 362/235; 362/253; 362/276; 362/347; 250/339.01; 250/554; 250/336.1; 250/338.1; 340/578; 340/577; 340/628

(58) Field of Classification Search ..... 702/64, 702/75, 134; 362/235, 236, 253, 276, 602, 362/347; 250/352, 339.15, 554, 342, 226, 250/336.1, 338.1, 339.05, 339.01, 216; 340/578, 340/577, 680, 628, 629, 630; 431/79
See application file for complete search history.

(56) References Cited

U.S. PATENT DOCUMENTS

| | | | | |
|---|---|---|---|---|
| 3,836,316 | A * | 9/1974 | Ikegami et al. | 431/79 |
| 4,370,557 | A * | 1/1983 | Axmark et al. | 250/554 |
| 4,671,362 | A * | 6/1987 | Odashima | 169/61 |
| 4,749,862 | A * | 6/1988 | Yoshida et al. | 250/342 |
| 4,800,285 | A * | 1/1989 | Akiba et al. | 250/554 |
| 4,983,853 | A * | 1/1991 | Davall et al. | 250/554 |
| 5,107,128 | A * | 4/1992 | Davall et al. | 250/554 |
| 5,726,451 | A * | 3/1998 | Ishida et al. | 250/339.15 |
| 6,057,549 | A * | 5/2000 | Castleman | 250/339.15 |
| 6,064,064 | A * | 5/2000 | Castleman | 250/339.15 |
| 6,078,050 | A * | 6/2000 | Castleman | 250/339.15 |
| 6,111,511 | A * | 8/2000 | Sivathanu et al. | 340/577 |
| 6,153,881 | A * | 11/2000 | Castleman | 250/339.15 |
| 6,184,792 | B1 * | 2/2001 | Privalov et al. | 340/578 |
| 6,239,435 | B1 * | 5/2001 | Castleman | 250/339.15 |
| 6,515,283 | B1 * | 2/2003 | Castleman et al. | 250/339.15 |
| 6,518,574 | B1 * | 2/2003 | Castleman | 250/339.15 |
| 6,806,471 | B2 * | 10/2004 | Matsukuma et al. | 250/339.15 |
| RE39,081 | E * | 5/2006 | Thomas | 340/578 |
| 7,154,095 | B2 * | 12/2006 | Luck et al. | 250/347 |
| 7,154,400 | B2 * | 12/2006 | Owrutsky et al. | 340/578 |
| 7,256,401 | B2 * | 8/2007 | Garmer et al. | 250/347 |

(Continued)

FOREIGN PATENT DOCUMENTS

JP 2000-315285 11/2000

*Primary Examiner* — Carol Tsai
(74) *Attorney, Agent, or Firm* — IPLA P.A.; James E. Bame

(57) ABSTRACT

A self check-type flame detector includes a casing provided with a monitoring window formed therein. A wavelength generation unit is disposed inside the casing and generates a wavelength in a direction of the monitoring window. A wavelength detection element is disposed inside the casing and detects the wavelength. A comparison unit is provided with a wavelength DB for storing intensity of a reference wavelength and determines whether the monitoring window has been contaminated. A display unit is located outside the casing and displays a state of the monitoring window. A communication unit is disposed inside the casing and configured to receive operation information for the wavelength generation unit, to provide the operation information to the wavelength generation unit, and to transmit the intensity of the wavelength, or a normal signal or a contamination signal of the monitoring window.

20 Claims, 8 Drawing Sheets

U.S. PATENT DOCUMENTS

| | | | | |
|---|---|---|---|---|
| 7,710,280 | B2 * | 5/2010 | McLellan | 340/578 |
| 7,786,877 | B2 * | 8/2010 | Hou | 340/578 |
| 8,201,973 | B2 * | 6/2012 | Kudoh et al. | 362/253 |
| 2002/0011570 | A1 * | 1/2002 | Castleman | 250/339.15 |
| 2003/0044042 | A1 * | 3/2003 | King et al. | 382/100 |
| 2003/0132388 | A1 * | 7/2003 | Matsukuma et al. | 250/339.15 |
| 2009/0315722 | A1 * | 12/2009 | Hou | 340/578 |
| 2010/0073926 | A1 * | 3/2010 | Kudoh et al. | 362/235 |
| 2012/0140231 | A1 * | 6/2012 | Knox et al. | 356/442 |

* cited by examiner

SELF CHECK-TYPE FLAME DETECTOR

BACKGROUND OF THE INVENTION

1. Field of the Invention

The present invention relates to a self check-type flame detector, which generates a specific wavelength therein in the direction of a monitoring window and detects a wavelength reflected from the monitoring window, thus determining based on the intensity of the wavelength reflected from the monitoring window whether the monitoring window has been contaminated.

Further, the present invention relates to a self check-type flame detector, which captures a monitoring window therein as an image and checks the turbidity of the captured image, thus determining whether the monitoring window has been contaminated.

2. Description of the Related Art

A flame detector, which is a kind of fire detector having a fast detection response, is configured such that the light receiving element of the flame detector detects the specific wavelength bands of ultraviolet (UV) rays and infrared (IR) rays radiated from a flame, generated when a fire first originates, and detects the generation of the flame at the start of a fire using electronic characteristics that light energy is converted into electrical energy.

Such a flame detector cannot cope with a deterioration in sensitivity when a monitoring window is covered with dust or the like, thus resulting in flames not being detected. Further, on the basis of the Fire Services Act, flame detectors are installed in sensitive fire regions and wide fireproof regions, such as semiconductor manufacturing companies, nuclear power plants, chemical complexes, iron and steel complexes, and paper factories which are located at the height of 20 m or more. Such a height may cause the effects of detection to be deteriorated in the case of the installation of existing fire detectors. Accordingly, it is impossible to provide a warning based on self check against the operating state, the abnormal state or the like of the detector, or to monitor such a state based on automatic check, and thus a defective flame detector may be left as it is without being timely repaired.

SUMMARY OF THE INVENTION

Accordingly, the present invention has been made keeping in mind the above problems occurring in the prior art, and an object of the present invention is to provide a self check-type flame detector, which generates a specific wavelength therein in the direction of a monitoring window and detects a wavelength reflected from the monitoring window, thus determining based on the intensity of the wavelength reflected from the monitoring window whether the monitoring window has been contaminated.

Another object of the present invention is to provide a self check-type flame detector, which captures a monitoring window therein as an image and checks the turbidity of the captured image, thus determining whether the monitoring window has been contaminated.

A further object of the present invention is to provide a self check-type flame detector, which enables the outer surface of a monitoring window to be cleaned if it is determined that the monitoring window has been contaminated by comparing the specific wavelength or the turbidity of the monitoring window with a reference value.

Yet another object of the present invention is to provide a self check-type flame detector, which detects whether the monitoring window of the flame detector has been contaminated, whether input voltage applied to the flame detector is abnormal, and whether the internal temperature of the flame detector is abnormal, and which can send a warning signal to a manager or the like of the flame detector if even at least one of the above three requirements is satisfied.

In accordance with a first embodiment of the present invention to accomplish the above objects, there is provided a self check-type flame detector, including a casing provided with a monitoring window formed therein; a wavelength generation unit disposed inside the casing and configured to generate a wavelength in a direction of the monitoring window; a wavelength detection element disposed inside the casing and configured to detect the wavelength generated by the wavelength generation unit; a comparison unit provided with a wavelength database (DB) for storing intensity of a reference wavelength and configured to determine whether the monitoring window has been contaminated by comparing intensity of the wavelength detected by the wavelength detection element with that of the reference wavelength stored in the wavelength DB; a display unit located outside the casing and configured to display a state of the monitoring window determined by the comparison unit; a communication unit disposed inside the casing and configured to receive operation information for the wavelength generation unit from outside of the casing, to provide the operation information to the wavelength generation unit, and to transmit the intensity of the wavelength detected by the wavelength detection element, or a normal signal or a contamination signal of the monitoring window determined by the comparison unit, to outside of the casing; a voltage abnormality determination unit for receiving a voltage value, obtained by dividing an input voltage applied to the flame detector using a voltage divider, and generating a voltage abnormality signal when the divided voltage value falls outside a range of a preset reference voltage; a temperature abnormality determination unit installed inside the casing and configured to receive a voltage value proportional to temperature from a semiconductor device which outputs the voltage value proportional to the temperature, and to generate a temperature abnormality signal when the voltage value proportional to the temperature falls outside a range of a preset reference voltage; and infrared (IR) and ultraviolet (UV) sensors installed inside the casing and configured to sense whether a fire is occurring, wherein the display unit includes a light emitting element for displaying a yellow signal when at least one of a monitoring window contamination signal, a voltage abnormality signal, and a temperature abnormality signal is received from the comparison unit, the voltage abnormality determination unit or the temperature abnormality determination unit, displaying a red signal when a fire occurrence signal indicative of occurrence of a fire is received from the IR and UV sensors, and displaying a green signal in remaining cases.

In accordance with a second embodiment of the present invention to accomplish the above objects, there is provided a self check-type flame detector, including a casing provided with a monitoring window formed therein; a reflective surface fastened to the casing and located outside the casing; a wavelength generation unit disposed inside the casing and configured to generate a wavelength in a direction of the reflective surface through the monitoring window; a wavelength detection element disposed inside the casing and configured to detect a wavelength reflected from the reflective surface through the monitoring window; a comparison unit provided with a wavelength database (DB) for storing intensity of a reference wavelength and configured to determine whether the monitoring window has been contaminated by comparing intensity of the wavelength detected by the wavelength detection element with that of the reference wavelength stored in the wavelength DB; a display unit located outside the casing and configured to display a state of the monitoring window determined by the comparison unit; and a communication unit disposed inside the casing and configured to receive operation information for the wavelength generation unit from outside of the casing, to provide the operation information to the wavelength generation unit and to transmit the intensity of the wavelength detected by the wavelength detection element, or a normal signal or a contamination signal of the monitoring window determined by the comparison unit, to outside of the casing.

Further, the self check-type flame detector may further include a voltage abnormality determination unit for receiving a voltage value, obtained by dividing an input voltage applied to the flame detector using a voltage divider, and generating a voltage abnormality signal when the divided voltage value falls outside a range of a preset reference voltage.

Further, the self check-type flame detector may further include a temperature abnormality determination unit installed inside the casing and configured to receive a voltage value proportional to temperature from a semiconductor device which outputs the voltage value proportional to the temperature, and to generate a temperature abnormality signal when the voltage value proportional to the temperature falls outside a range of a preset reference voltage.

Furthermore, the self check-type flame detector may further include infrared (IR) and ultraviolet (UV) sensors installed inside the casing and configured to sense whether a fire is occurring, wherein the display unit includes a light emitting element for displaying a yellow signal when at least one of a monitoring window contamination signal, a voltage abnormality signal, and a temperature abnormality signal is received from the comparison unit, the voltage abnormality determination unit or the temperature abnormality determination unit, displaying a red signal when a fire occurrence signal indicative of occurrence of a fire is received from the IR and UV sensors, and displaying a green signal in remaining cases.

In accordance with a third embodiment of the present invention to accomplish the above objects, there is provided a self check-type flame detector, including a casing provided with a monitoring window formed therein; a wavelength generation unit fastened to the casing, located outside the casing, and configured to generate a wavelength in a direction of a wavelength detection element through the monitoring window; the wavelength detection element disposed inside the casing and configured to detect the wavelength generated by the wavelength generation unit; a comparison unit provided with a wavelength database (DB) for storing intensity of a reference wavelength and configured to determine whether the monitoring window has been contaminated by comparing intensity of the wavelength detected by the wavelength detection element with that of the reference wavelength stored in the wavelength DB; a display unit located outside the casing and configured to display a state of the monitoring window determined by the comparison unit; and a communication unit disposed inside the casing and configured to receive operation information for the wavelength generation unit from outside of the casing, to provide the operation information to the wavelength generation unit and to transmit the intensity of the wavelength detected by the wavelength detection element, or a normal signal or a contamination signal of the monitoring window determined by the comparison unit, to outside of the casing.

Further, the self check-type flame detector may further include a voltage abnormality determination unit for receiving a voltage value, obtained by dividing an input voltage applied to the flame detector using a voltage divider, and generating a voltage abnormality signal when the divided voltage value falls outside a range of a preset reference voltage.

Further, the self check-type flame detector may further include a temperature abnormality determination unit installed inside the casing and configured to receive a voltage value proportional to temperature from a semiconductor device which outputs the voltage value proportional to the temperature, and to generate a temperature abnormality signal when the voltage value proportional to the temperature falls outside a range of a preset reference voltage.

Furthermore, the self check-type flame detector may further include infrared (IR) and ultraviolet (UV) sensors installed inside the casing and configured to sense whether a fire is occurring, wherein the display unit includes a light emitting element for displaying a yellow signal when at least one of a monitoring window contamination signal, a voltage abnormality signal, and a temperature abnormality signal is received from the comparison unit, the voltage abnormality determination unit or the temperature abnormality determination unit, displaying a red signal when a fire occurrence signal indicative of occurrence of a fire is received from the IR and UV sensors, and displaying a green signal in remaining cases.

In accordance with a forth embodiment of the present invention to accomplish the above objects, there is provided a self check-type flame detector, including a casing provided with a monitoring window formed therein; a wavelength generation unit installed in a remote control and configured to generate a wavelength in a direction of a wavelength detection element through the monitoring window; the wavelength detection element disposed inside the casing and configured to detect the wavelength generated by the wavelength generation unit; a comparison unit provided with a wavelength database (DB) for storing intensity of a reference wavelength and configured to determine whether the monitoring window has been contaminated by comparing intensity of the wavelength detected by the wavelength detection element with that of the reference wavelength stored in the wavelength DB; a display unit located outside the casing and configured to display a state of the monitoring window determined by the comparison unit; and a communication unit configured to transmit the intensity of the wavelength detected by the wavelength detection element, or a normal signal or a contamination signal of the monitoring window determined by the comparison unit, to outside of the casing.

Further, the self check-type flame detector may further include a voltage abnormality determination unit for receiving a voltage value, obtained by dividing an input voltage applied to the flame detector using a voltage divider, and generating a voltage abnormality signal when the divided voltage value falls outside a range of a preset reference voltage.

Further, the self check-type flame detector may further include a temperature abnormality determination unit installed inside the casing and configured to receive a voltage value proportional to temperature from a semiconductor device which outputs the voltage value proportional to the temperature, and to generate a temperature abnormality signal when the voltage value proportional to the temperature falls outside a range of a preset reference voltage.

Furthermore, the self check-type flame detector may further include infrared (IR) and ultraviolet (UV) sensors installed inside the casing and configured to sense whether a fire is occurring, wherein the display unit includes a light emitting element for displaying a yellow signal when at least one of a monitoring window contamination signal, a voltage abnormality signal, and a temperature abnormality signal is received from the comparison unit, the voltage abnormality determination unit or the temperature abnormality determination unit, displaying a red signal when a fire occurrence signal indicative of occurrence of a fire is received from the IR and UV sensors, and displaying a green signal in remaining cases.

In accordance with a fifth embodiment of the present invention to accomplish the above objects, there is provided a self check-type flame detector, including a casing provided with a monitoring window formed therein; a light emitting unit disposed inside the casing and configured to generate light in a direction of the monitoring window; a camera disposed inside the casing and configured to capture the monitoring window; a turbidity comparison unit provided with a turbidity database (DB) for storing turbidity of a reference image that is used to determine contamination of the monitoring window, the turbidity comparison unit determining whether the monitoring window has been contaminated by comparing turbidity of an image captured by the camera with the turbidity of the reference image stored in the turbidity DB; a display unit located outside the casing and configured to display a state of the monitoring window determined by the turbidity comparison unit; a voltage abnormality determination unit for receiving a voltage value, obtained by dividing an input voltage applied to the flame detector using a voltage divider, and generating a voltage abnormality signal when the divided voltage value falls outside a range of a preset reference voltage; a temperature abnormality determination unit installed inside the casing and configured to receive a voltage value proportional to temperature from a semiconductor device which outputs the voltage value proportional to the temperature, and to generate a temperature abnormality signal when the voltage value proportional to the temperature falls outside a range of a preset reference voltage; and infrared (IR) and ultraviolet (UV) sensors installed inside the casing and configured to sense whether a fire is occurring, wherein the display unit includes a light emitting element for displaying a yellow signal when at least one of a monitoring window contamination signal, a voltage abnormality signal, and a temperature abnormality signal is received from the comparison unit, the voltage abnormality determination unit or the temperature abnormality determination unit, displaying a red signal when a fire occurrence signal indicative of occurrence of a fire is received from the IR and UV sensors, and displaying a green signal in remaining cases.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, embodiments of the present invention will be described in detail with reference to the attached drawings.

Figure 1:
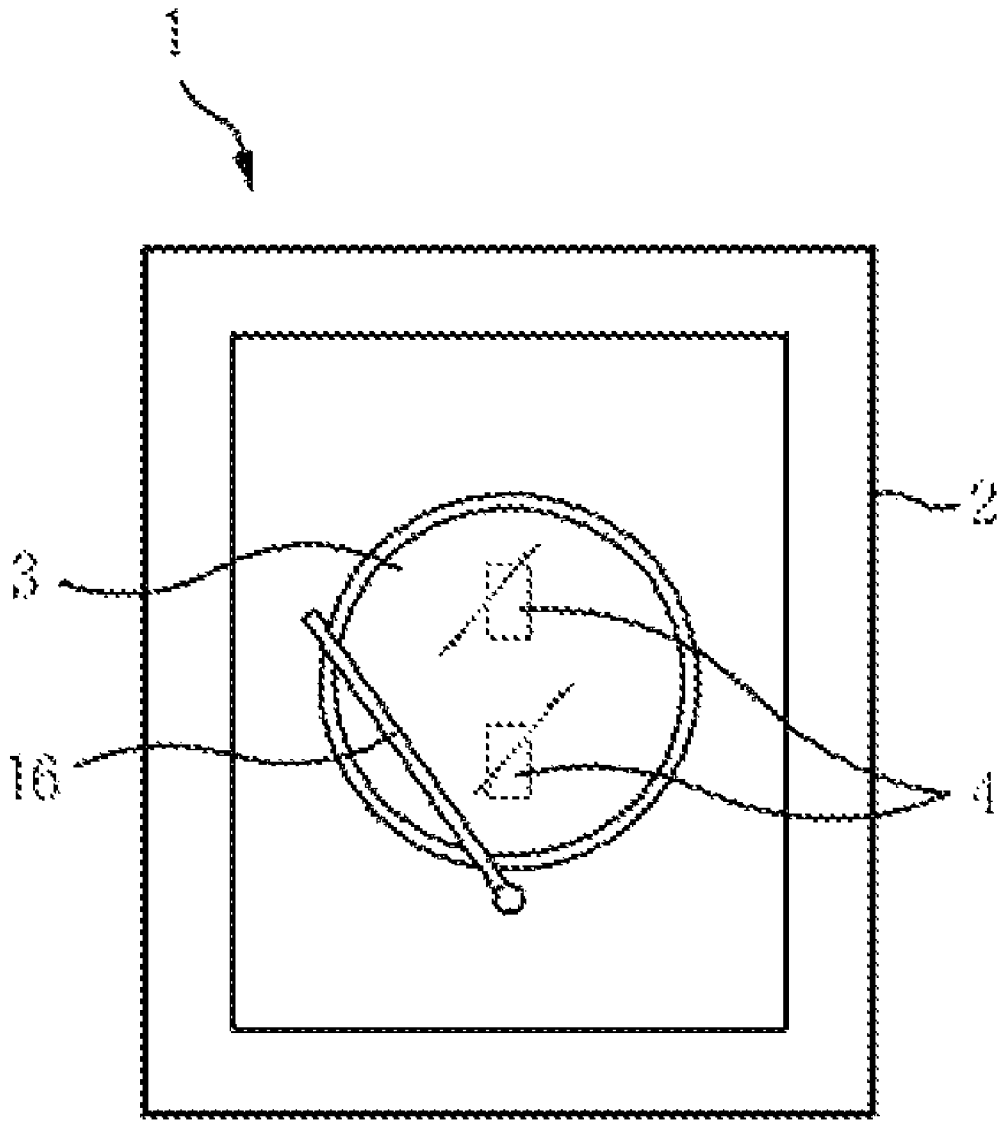
FIG. 1 is a front view of a self check-type flame detector according to the present invention.
Figure 2:
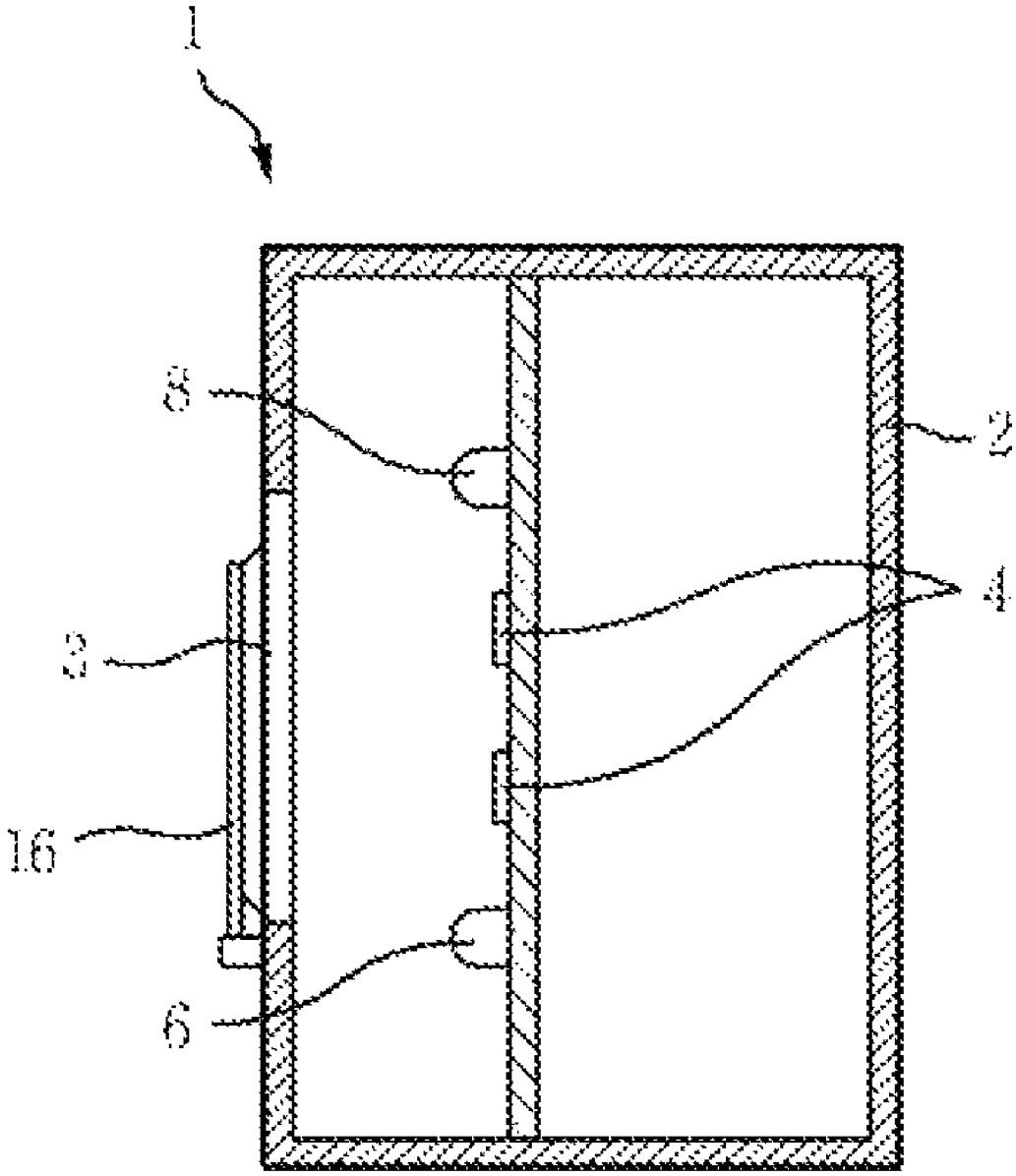
FIG. 2 is a schematic diagram showing a self check-type flame detector according to a first embodiment of the present invention.
Figure 3:
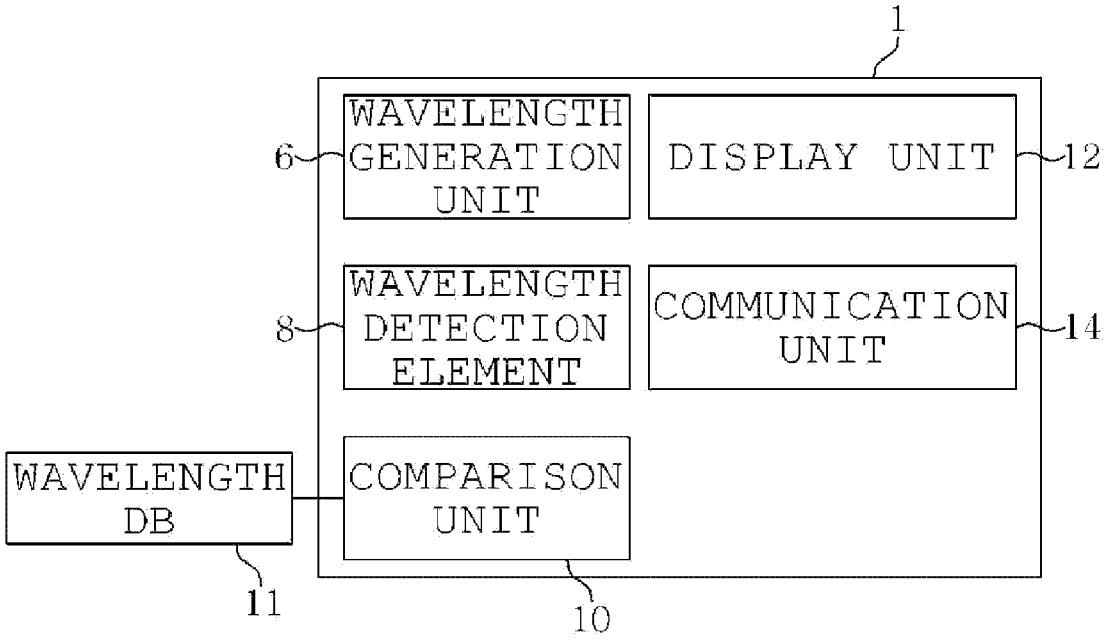
FIG. 3 is a block diagram showing a self check-type flame detector according to first to fourth embodiments of the present invention.

FIG. 1 is a front view of a self check-type flame detector according to the present invention, FIG. 2 is a schematic diagram showing a self check-type flame detector according to a first embodiment of the present invention, and FIG. 3 is a block diagram showing a self check-type flame detector according to first to fourth embodiments of the present invention.

As shown in FIGS. 1 to 3, a self check-type flame detector according to a first embodiment of the present invention is configured such that infrared (IR) and ultraviolet (UV) sensors 4 for sensing IR rays and UV rays radiated from an externally generated flame are disposed inside a casing 2 in which a monitoring window 3 is formed. The monitoring window 3 and the IR and UV sensors 4 may be mounted in typical flame detectors, and thus a detailed description thereof is omitted.

A wavelength generation unit 6 for generating a wavelength in the direction of the monitoring window 3 is located in a portion of the inside of the casing 2. A wavelength detection element 8 for detecting the wavelength generated by the wavelength generation unit 6 is located in another portion of the inside of the casing 2. In this case, when the wavelength generation unit 6 generates the same wavelength as that generated by a flame, the IR sensor or the UV sensor can be used as the wavelength detection element. Accordingly, in the case where the wavelength generation unit 6 generates the wavelength in the direction of the monitoring window 3, if the outer surface of the monitoring window is not contaminated, a small amount of wavelength is reflected from the monitoring window, whereas if a large portion of the outer surface of the monitoring window is contaminated, a large amount of wavelength is reflected therefrom, and is then detected by the wavelength detection element.

Further, a comparison unit 10 for determining whether the monitoring window has been contaminated by comparing the intensity of the wavelength detected by the wavelength detection element 8 with a reference wavelength is disposed inside the casing 2. The comparison unit 10 includes a wavelength database (DB) 11 for storing the reference wavelength which is used to determine contamination. When the intensity of the wavelength detected by the wavelength detection element 8 is greater than that of the reference wavelength, the comparison unit 10 determines that the monitoring window has been contaminated, and generates a contamination signal. In detail, when the intensity of the wavelength, detected by the wavelength detection element 8 which detects the intensity of the wavelength reflected from the monitoring window 3, is less than that of the reference wavelength, the comparison unit 10 determines that the flame detector 1 can be normally operated, and then generates a normal signal. In contrast, when the intensity of the wavelength detected by the wavelength detection element 8 is greater than that of the reference wavelength, the comparison unit 10 determines that the flame detector 1 cannot be normally operated, and then generates a contamination signal.

Meanwhile, a display unit 12 for displaying the state of contamination is located outside the casing 2, and then receives and displays the normal signal or the contamination signal generated by the comparison unit 10. The display unit 12 can be implemented using a green Light Emitting Diode (LED) for indicating a normal state and a red LED for indicating a contaminated state.

Further, a communication unit 14 is disposed in the casing 2, and is provided with operation information from the outside (or inside) of the flame detector so as to enable the set wavelength to be generated by the wavelength generation unit 6. The communication unit 14 is configured to transmit the intensity of the wavelength, detected by the wavelength detection element 8, or the normal signal or the contamination signal of the monitoring window, determined by the comparison unit 10, to the outside of the flame detector.

Such a communication unit 14 is connected to an external management center and is configured to directly exchange the operation information and the contamination information with the management center, or exchange the operation information and the contamination information with a mobile controller.

Meanwhile, a contaminant elimination unit 16 for eliminating contaminants from the monitoring window is disposed on the outer surface of the monitoring window 3. The contaminant elimination unit 16 receives the contamination signal generated by the comparison unit and then operates.

Such a contaminant elimination unit 16 may be implemented as a compressed air generation device for blowing compressed air onto the monitoring window 3 and eliminating contaminants, a brusher for cleaning the monitoring window while rotating, or a water supply device for eliminating contaminants using water.

Further, a voltage abnormality determination unit receives a voltage value obtained by dividing the input voltage applied to the flame detector using a voltage divider, and generates a voltage abnormality signal when the divided voltage falls outside the range of the preset reference voltage.

Meanwhile, a temperature abnormality determination unit installed in the casing 2 receives a voltage value proportional to temperature from a semiconductor device which outputs the voltage value proportional to the temperature, and then generates a temperature abnormality signal when the voltage value proportional to the temperature falls outside the range of the preset reference voltage.

In this case, the voltage abnormality determination unit and the temperature abnormality determination unit may be implemented in a single microcomputer, and the voltage divider may be implemented as a typical resistor divider. A node divided by the resistor divider is electrically connected to a specific port of the microcomputer.

Further, as a semiconductor device which outputs a voltage value proportional to temperature, a semiconductor device such as TC1047 may be used. A node at which a voltage proportional to temperature is output from such a semiconductor device is also electrically connected to the specific port of the above microcomputer.

Meanwhile, the infrared (IR) sensor and the ultraviolet (UV) sensor for sensing the occurrence of a fire are installed in the casing 2.

Further, the display unit 12 includes a light emitting element for displaying a yellow signal when at least one of a monitoring window 3 contamination signal, a voltage abnormality signal and a temperature abnormality signal is received from the comparison unit 10, the voltage abnormality determination unit or the temperature abnormality determination unit, for displaying a red signal when a fire occurrence signal indicative of the occurrence of a fire is received from the IR and the UV sensors, and for displaying a green signal in other cases.

Here, the light emitting element of the display unit 12 is preferably implemented as an LED.

Figure 4:
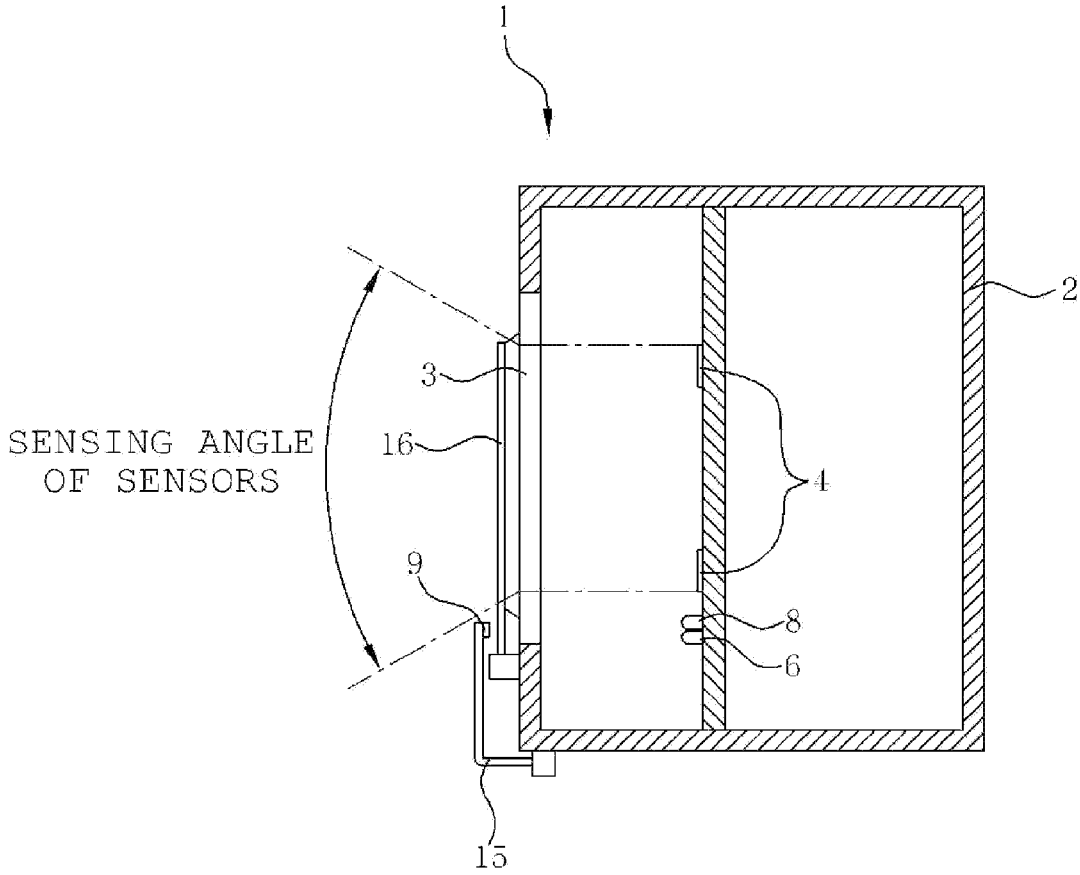
FIG. 4 is a schematic diagram showing a self check-type flame detector according to a second embodiment of the present invention.

FIG. 4 is a schematic diagram showing a self check-type flame detector according to a second embodiment of the present invention.

Referring to FIG. 4, the self check-type flame detector according to the second embodiment of the present invention includes a reflective surface 9 fastened to a casing by a support element 15 and located outside the casing. A wavelength generation unit 6 is disposed inside the casing and generates a wavelength in the direction of the reflective surface 9 through a monitoring window. A wavelength detection element 8 is disposed inside the casing, and detects a wavelength reflected from the reflective surface through the monitoring window.

Here, the reflective surface 9 is preferably disposed to deviate from the sensing area of IR and UV sensors 4, that is, the sensing angle of the sensors, as shown in FIG. 4.

A light emitting element which is the wavelength generation unit 6 and a light receiving element which is the wavelength detection element 8 are preferably implemented as LEDs.

A comparison unit 10 is provided with a wavelength DB 11 for storing the intensity of a reference wavelength that is used to determine contamination. When the intensity of the wavelength detected by the wavelength detection element 8 is less than that of the reference wavelength, the comparison unit 10 determines that the monitoring window has been contaminated, and the generates a contamination signal. In detail, when the intensity of the wavelength detected by the wavelength detection element 8 which detects the intensity of the wavelength reflected through the monitoring window 3 is greater than that of the reference wavelength, the comparison unit 10 determines that the flame detector 1 can be normally operated, and then generates a normal signal. In contrast, when the intensity of the wavelength detected by the wavelength detection element 8 is less than that of the reference wavelength, the comparison unit 10 determines that the flame detector cannot be normally operated, and then generates a contamination signal.

The operations and functions of the remaining components of the second embodiment of the present invention, which are not described above, are identical to those of the first embodiment of the present invention.

Figure 5:
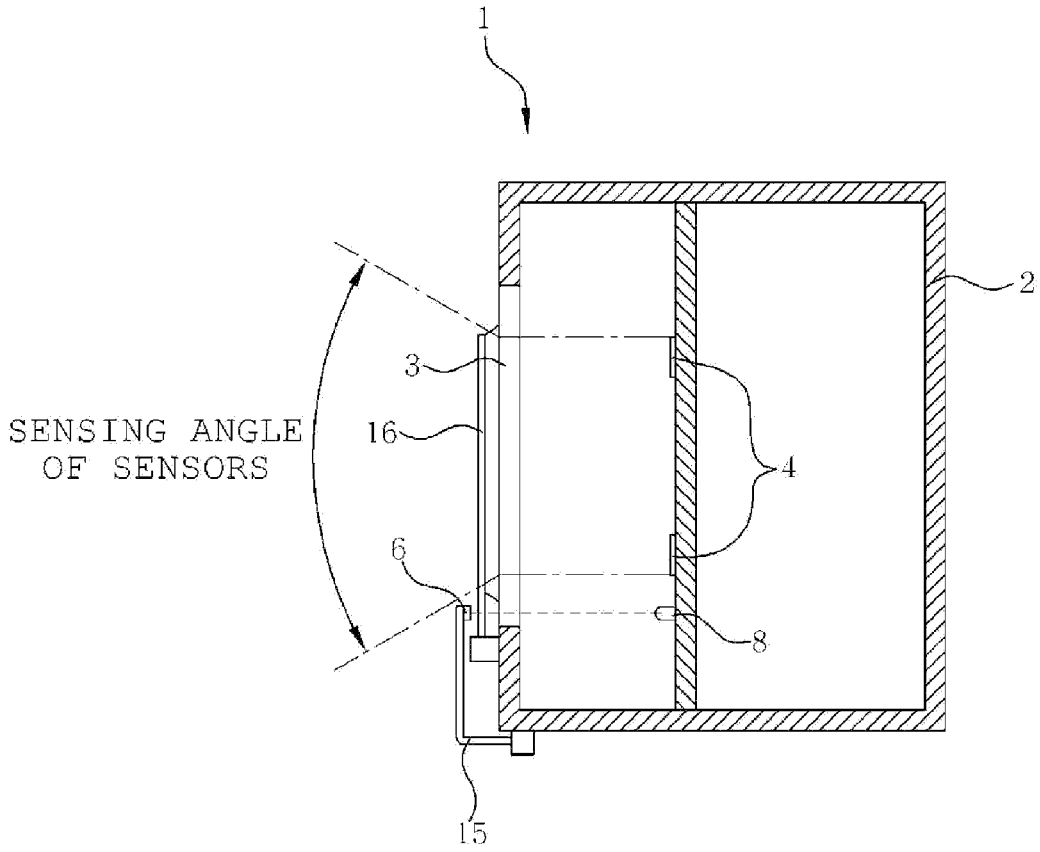
FIG. 5 is a schematic diagram showing a self check-type flame detector according to a third embodiment of the present invention.

FIG. 5 is a schematic diagram showing a self check-type flame detector according to a third embodiment of the present invention.

Referring to FIG. 5, the self check-type flame detector according to the third embodiment of the present invention is constructed such that a wavelength generation unit 6 is fastened to a casing by a support element 15 and located outside the casing and is configured to generate a wavelength in the direction of a wavelength detection element 8 through a monitoring window. The wavelength detection element 8 is disposed inside the casing and is configured to detect the wavelength generated by the wavelength generation unit 6.

Here, the wavelength generation unit 6 is preferably located to deviate from the sensing area of IR and UV sensors 4, that is, the sensing angle of the sensors, as shown in FIG. 5.

Similarly to the second embodiment of the present invention, a comparison unit 10 determines that the monitoring window has been contaminated and generates a contamination signal when the intensity of the wavelength detected by the wavelength detection element 8 is less than that of a reference wavelength, whereas it generates a normal signal when the intensity of the wavelength detected by the wavelength detection element 8 is greater than that of the reference wavelength.

The operations and functions of the remaining components of the third embodiment of the present invention, which are not described above, are identical to those of the first embodiment of the present invention.

Figure 6:
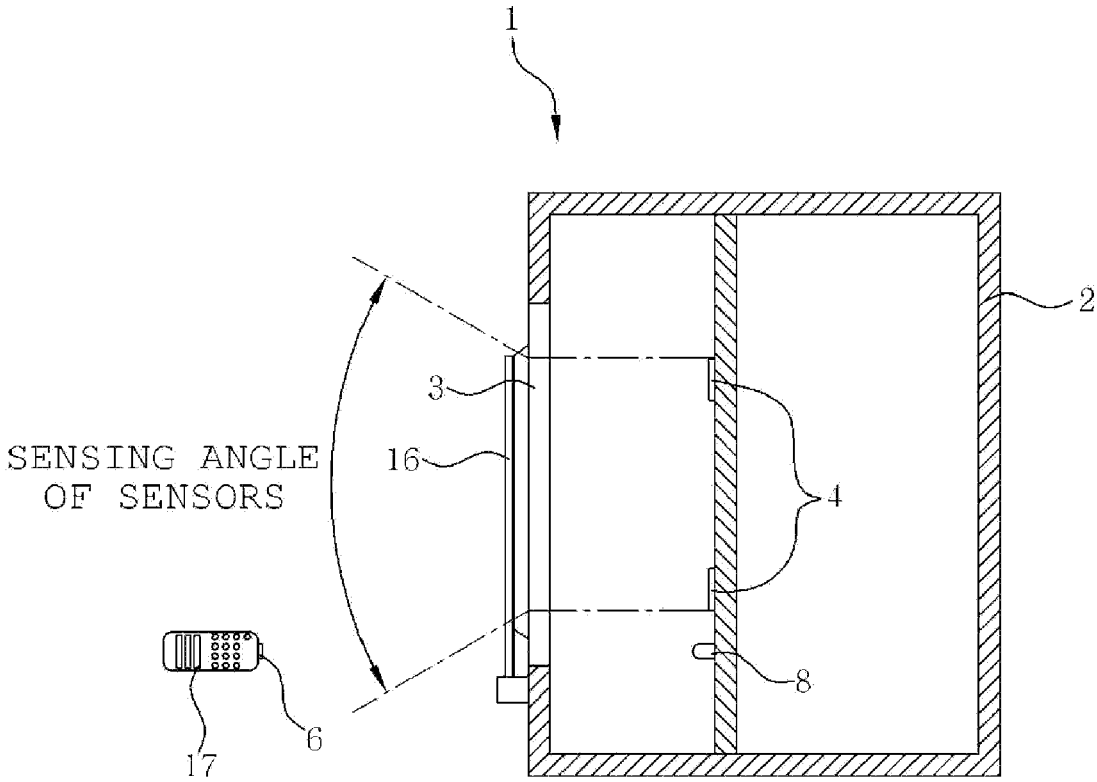
FIG. 6 is a schematic diagram showing a self check-type flame detector according to a fourth embodiment of the present invention.

FIG. 6 is a schematic diagram showing a self check-type flame detector according to a fourth embodiment of the present invention.

Referring to FIG. 6, the self check-type flame detector according to the fourth embodiment of the present invention is constructed such that a wavelength generation unit 6 is installed in a separate remote control 17 and configured to generate a wavelength in the direction of a wavelength detection element through a monitoring window by allowing a user to manipulate the remote control 17. A wavelength detection element 8 is disposed inside a casing and configured to detect the wavelength generated by the wavelength generation unit 6.

Similarly to the second embodiment of the present invention, a comparison unit 10 determines that the monitoring window has been contaminated and generates a contamination signal when the intensity of the wavelength detected by the wavelength detection element 8 is less than that of the reference wavelength, whereas it generates a normal signal when the intensity of the wavelength detected by the wavelength detection element 8 is greater than that of a reference wavelength.

The operations and functions of the remaining components of the fourth embodiment of the present invention, which are not described above, are identical to those of the first embodiment of the present invention.

The self check-type flame detector according to the fourth embodiment of the present invention is advantageous in that the user can carry the remote control and can check the contamination level of each flame detector.

Figure 7:
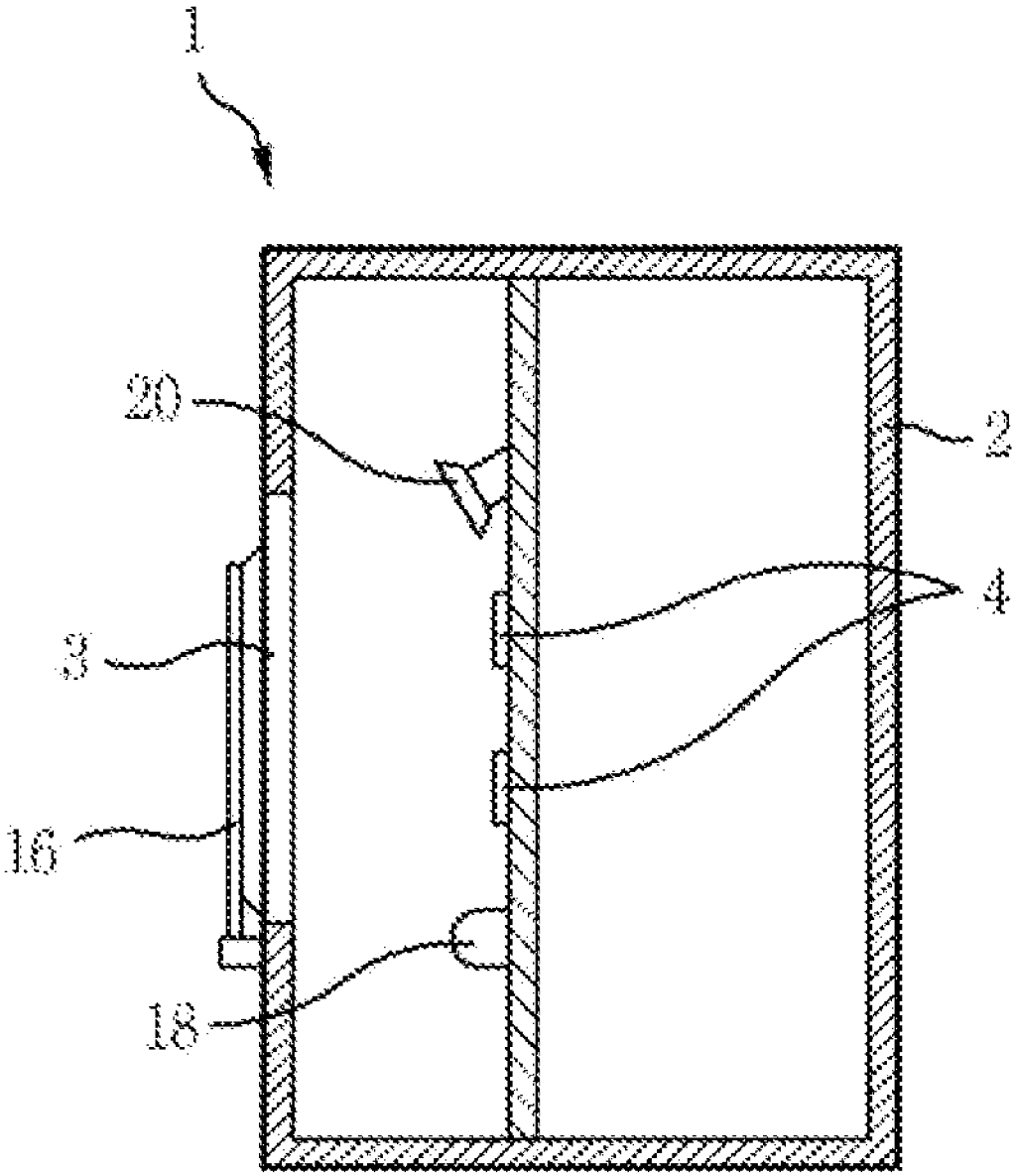
FIG. 7 is a schematic diagram showing a self check-type flame detector according to a fifth embodiment of the present invention.
Figure 8:
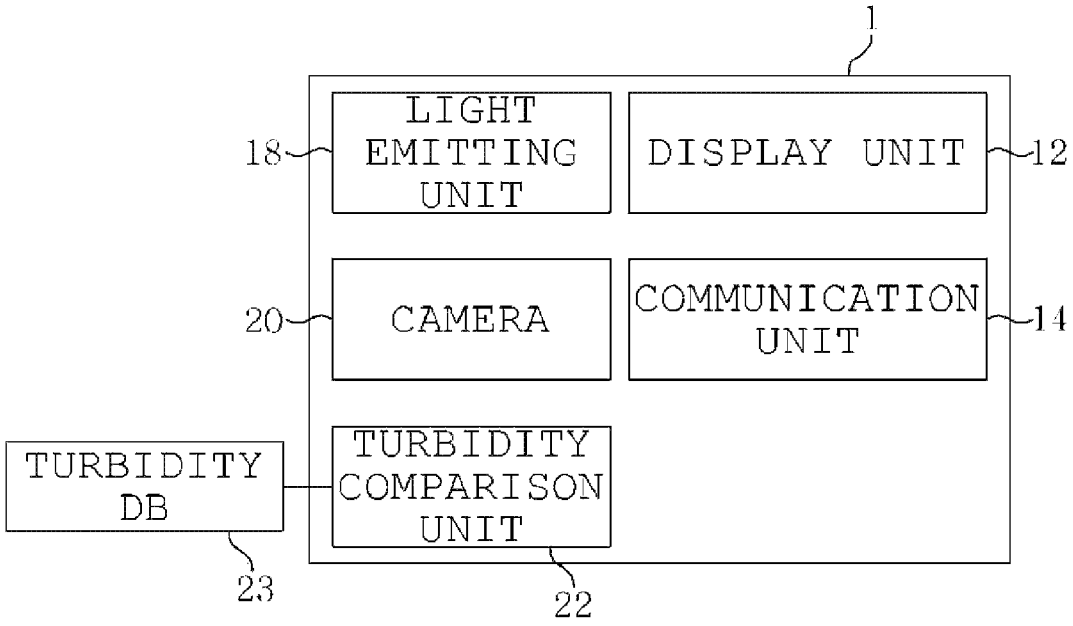
FIG. 8 is a block diagram showing the self check-type flame detector according to the fifth embodiment of the present invention.

As shown in FIGS. 7 and 8, a self check-type flame detector according to a fifth embodiment of the present invention is configured such that a light emitting unit 18 for emitting light to a monitoring window is located in a portion of the inside of the flame detector, and such that a camera 20 for capturing the outside of a casing is disposed inside the casing. When light is emitted by the light emitting unit 18, the monitoring window 3 can be maintained at a predetermined illuminance or more.

Further, a turbidity comparison unit 22 for determining the state of the contamination of the monitoring window by comparing the turbidity of an image captured by the camera 20 with that of a reference image is disposed inside the monitoring window 3. With respect to the turbidity comparison unit 22, the turbidity of the reference image that is used to determine contamination is stored in a turbidity DB 23.

Accordingly, when the turbidity of the image captured by the camera is greater than that of the reference image as a result of the determination by the turbidity comparison unit 22, the turbidity comparison unit 22 determines that the monitoring window has been contaminated and generates a contamination signal. In contrast, when the turbidity of the image captured by the camera 20 is less than that of the reference image, the turbidity comparison unit 22 determines that the monitoring window has not been contaminated and generates a normal signal.

As described above, the self check-type flame detector according to the present invention is advantageous in that a specific wavelength is generated in the flame detector in the direction of a monitoring window, and a wavelength reflected from the monitoring window is detected, so that whether the monitoring window has been contaminated can be determined, thus enabling the appearance of the flame detector to be simplified.

Further, the present invention is advantageous in that when images captured by a camera that captures a flame are used, separate determination equipment capable of determining whether a monitoring window has been contaminated is not required.

Furthermore, the present invention is advantageous in that when it is determined that a monitoring window has been contaminated, the monitoring window can be cleaned outside a flame detector and can be kept clean.

Furthermore, the present invention is advantageous in that whether the monitoring window of a flame detector has been contaminated, whether voltage input to the flame detector is abnormal, and whether the internal temperature of the flame detector is abnormal are determined, and thus a warning signal can be provided to a manager or the like of the flame detector if it is determined that even at least one of the three requirements is satisfied.

Although the preferred embodiments of the present invention have been disclosed for illustrative purposes, those skilled in the art will appreciate that various improvements, modifications, substitutions and additions and are possible, without departing from the scope and spirit of the invention as disclosed in the accompanying claims. When these improvements, modifications, substitutions and additions are included in the scope of the accompanying claims, the technical spirit thereof is also interpreted as being included in the scope of the present invention.

What is claimed is:

1. A self check-type flame detector, comprising:

a casing provided with a monitoring window formed therein;

a wavelength generation unit disposed inside the casing and configured to generate a wavelength in a direction of the monitoring window;

a wavelength detection element disposed inside the casing and configured to detect the wavelength generated by the wavelength generation unit;

a comparison unit provided with a wavelength database (DB) for storing intensity of a reference wavelength and configured to determine whether the monitoring window has been contaminated by comparing intensity of the wavelength detected by the wavelength detection element with that of the reference wavelength stored in the wavelength DB;

a display unit located outside the casing and configured to display a state of the monitoring window determined by the comparison unit; and a communication unit disposed inside the casing and configured to receive operation information for the wavelength generation unit from outside of the casing, to provide the operation information to the wavelength generation unit, and to transmit the intensity of the wavelength detected by the wavelength detection element, or a normal signal or a contamination signal of the monitoring window determined by the comparison unit, to outside of the casing.

2. The self check-type flame detector according to claim 1, further comprising a voltage abnormality determination unit for receiving a voltage value, obtained by dividing an input voltage applied to the flame detector using a voltage divider, and generating a voltage abnormality signal when the divided voltage value falls outside a range of a preset reference voltage.

3. The self check-type flame detector according to claim 2, further comprising a temperature abnormality determination unit installed inside the casing and configured to receive a voltage value proportional to temperature from a semiconductor device which outputs the voltage value proportional to the temperature, and to generate a temperature abnormality signal when the voltage value proportional to the temperature falls outside a range of a preset reference voltage.

4. The self check-type flame detector according to claim 3, further comprising infrared (IR) and ultraviolet (UV) sensors installed inside the casing and configured to sense whether a fire is occurring, wherein the display unit comprises a light emitting element for displaying a yellow signal when at least one of a monitoring window contamination signal, a voltage abnormality signal, and a temperature abnormality signal is received from the comparison unit, the voltage abnormality determination unit or the temperature abnormality determination unit, displaying a red signal when a fire occurrence signal indicative of occurrence of a fire is received from the IR and UV sensors, and displaying a green signal in remaining cases.

5. A self check-type flame detector, comprising:

a casing provided with a monitoring window formed therein;

a reflective surface fastened to the casing and located outside the casing;

a wavelength generation unit disposed inside the casing and configured to generate a wavelength in a direction of the reflective surface through the monitoring window;

a wavelength detection element disposed inside the casing and configured to detect a wavelength reflected from the reflective surface through the monitoring window;

a comparison unit provided with a wavelength database (DB) for storing intensity of a reference wavelength and configured to determine whether the monitoring window has been contaminated by comparing intensity of the wavelength detected by the wavelength detection element with that of the reference wavelength stored in the wavelength DB;

a display unit located outside the casing and configured to display a state of the monitoring window determined by the comparison unit; and a communication unit disposed inside the casing and configured to receive operation information for the wavelength generation unit from outside of the casing, to provide the operation information to the wavelength generation unit and to transmit the intensity of the wavelength detected by the wavelength detection element, or a normal signal or a contamination signal of the monitoring window determined by the comparison unit, to outside of the casing.

6. The self check-type flame detector, according to claim 5, further comprising a voltage abnormality determination unit for receiving a voltage value, obtained by dividing an input voltage applied to the flame detector using a voltage divider, and generating a voltage abnormality signal when the divided voltage value falls outside a range of a preset reference voltage.

7. The self check-type flame detector according to claim 6, further comprising a temperature abnormality determination unit installed inside the casing and configured to receive a voltage value proportional to temperature from a semiconductor device which outputs the voltage value proportional to the temperature, and to generate a temperature abnormality signal when the voltage value proportional to the temperature falls outside a range of a preset reference voltage.

8. The self check-type flame detector according to claim 7, further comprising infrared (IR) and ultraviolet (UV) sensors installed inside the casing and configured to sense whether a fire is occurring, wherein the display unit comprises a light emitting element for displaying a yellow signal when at least one of a monitoring window contamination signal, a voltage abnormality signal, and a temperature abnormality signal is received from the comparison unit, the voltage abnormality determination unit or the temperature abnormality determination unit, displaying a red signal when a fire occurrence signal indicative of occurrence of a fire is received from the IR and UV sensors, and displaying a green signal in remaining cases.

9. A self check-type flame detector, comprising:

a casing provided with a monitoring window formed therein;

a wavelength generation unit fastened to the casing, located outside the casing, and configured to generate a wavelength in a direction of a wavelength detection element through the monitoring window;

the wavelength detection element disposed inside the casing and configured to detect the wavelength generated by the wavelength generation unit;

a comparison unit provided with a wavelength database (DB) for storing intensity of a reference wavelength and configured to determine whether the monitoring window has been contaminated by comparing intensity of the wavelength detected by the wavelength detection element with that of the reference wavelength stored in the wavelength DB;

a display unit located outside the casing and configured to display a state of the monitoring window determined by the comparison unit; and a communication unit disposed inside the casing and configured to receive operation information for the wavelength generation unit from outside of the casing, to provide the operation information to the wavelength generation unit and to transmit the intensity of the wavelength detected by the wavelength detection element, or a normal signal or a contamination signal of the monitoring window determined by the comparison unit, to outside of the casing.

10. The self check-type flame detector according to claim 9, further comprising a voltage abnormality determination unit for receiving a voltage value, obtained by dividing an input voltage applied to the flame detector using a voltage divider, and generating a voltage abnormality signal when the divided voltage value falls outside a range of a preset reference voltage.

11. The self check-type flame detector according to claim 10, further comprising a temperature abnormality determination unit installed inside the casing and configured to receive a voltage value proportional to temperature from a semiconductor device which outputs the voltage value proportional to the temperature, and to generate a temperature abnormality signal when the voltage value proportional to the temperature falls outside a range of a preset reference voltage.

12. The self check-type flame detector according to claim 11, further comprising infrared (IR) and ultraviolet (UV) sensors installed inside the casing and configured to sense whether a fire is occurring, wherein the display unit comprises a light emitting element for displaying a yellow signal when at least one of a monitoring window contamination signal, a voltage abnormality signal, and a temperature abnormality signal is received from the comparison unit, the voltage abnormality determination unit or the temperature abnormality determination unit, displaying a red signal when a fire occurrence signal indicative of occurrence of a fire is received from the IR and UV sensors, and displaying a green signal in remaining cases.

13. A self check-type flame detector, comprising:

a casing provided with a monitoring window formed therein;

a wavelength generation unit installed in a remote control and configured to generate a wavelength in a direction of a wavelength detection element through the monitoring window;

the wavelength detection element disposed inside the casing and configured to detect the wavelength generated by the wavelength generation unit;

a comparison unit provided with a wavelength database (DB) for storing intensity of a reference wavelength and configured to determine whether the monitoring window has been contaminated by comparing intensity of the wavelength detected by the wavelength detection element with that of the reference wavelength stored in the wavelength DB;

a display unit located outside the casing and configured to display a state of the monitoring window determined by the comparison unit; and a communication unit configured to transmit the intensity of the wavelength detected by the wavelength detection element, or a normal signal or a contamination signal of the monitoring window determined by the comparison unit, to outside of the casing.

14. The self check-type flame detector according to claim 13, further comprising a voltage abnormality determination unit for receiving a voltage value, obtained by dividing an input voltage applied to the flame detector using a voltage divider, and generating a voltage abnormality signal when the divided voltage value falls outside a range of a preset reference voltage.

15. The self check-type flame detector according to claim 14, further comprising a temperature abnormality determination unit installed inside the casing and configured to receive a voltage value proportional to temperature from a semiconductor device which outputs the voltage value proportional to the temperature, and to generate a temperature abnormality signal when the voltage value proportional to the temperature falls outside a range of a preset reference voltage.

16. The self check-type flame detector according to claim 15, further comprising infrared (IR) and ultraviolet (UV) sensors installed inside the casing and configured to sense whether a fire is occurring, wherein the display unit comprises a light emitting element for displaying a yellow signal when at least one of a monitoring window contamination signal, a voltage abnormality signal, and a temperature abnormality signal is received from the comparison unit, the voltage abnormality determination unit or the temperature abnormality determination unit, displaying a red signal when a fire occurrence signal indicative of occurrence of a fire is received from the IR and UV sensors, and displaying a green signal in remaining cases.

17. A self check-type flame detector, comprising:

a casing provided with a monitoring window formed therein;

a light emitting unit disposed inside the casing and configured to generate light in a direction of the monitoring window;

a camera disposed inside the casing and configured to capture the monitoring window;

a turbidity comparison unit provided with a turbidity database (DB) for storing turbidity of a reference image that is used to determine contamination of the monitoring window, the turbidity comparison unit determining whether the monitoring window has been contaminated by comparing turbidity of an image captured by the camera with the turbidity of the reference image stored in the turbidity DB; and a display unit located outside the casing and configured to display a state of the monitoring window determined by the turbidity comparison unit.

18. The self check-type flame detector according to claim 17, further comprising a voltage abnormality determination unit for receiving a voltage value, obtained by dividing an input voltage applied to the flame detector using a voltage divider, and generating a voltage abnormality signal when the divided voltage value falls outside a range of a preset reference voltage.

19. The self check-type flame detector according to claim 18, further comprising a temperature abnormality determination unit installed inside the casing and configured to receive a voltage value proportional to temperature from a semiconductor device which outputs the voltage value proportional to the temperature, and to generate a temperature abnormality signal when the voltage value proportional to the temperature falls outside a range of a preset reference voltage.

20. The self check-type flame detector according to claim 19, further comprising infrared (IR) and ultraviolet (UV) sensors installed inside the casing and configured to sense whether a fire is occurring, wherein the display unit comprises a light emitting element for displaying a yellow signal when at least one of a monitoring window contamination signal, a voltage abnormality signal, and a temperature abnormality signal is received from the comparison unit, the voltage abnormality determination unit or the temperature abnormality determination unit, displaying a red signal when a fire occurrence signal indicative of occurrence of a fire is received from the IR and UV sensors, and displaying a green signal in remaining cases.

* * * * *